US005626274A

United States Patent [19]

Shkolnikov et al.

[11] Patent Number: 5,626,274

[45] Date of Patent: May 6, 1997

[54] NAIL STRIP MAGAZINE WITH SPRING LEAF TO BIAS FEEDING MEMBER AND TO SEPARATE NAIL STRIPS

[75] Inventors: Yury Shkolnikov, Glenview; Tony Deieso, Wadsworth; Mohamed K. Wagdy, Arlington Heights; Frank C. Howard, Mount Prospect, all of Ill.

[73] Assignee: Illinois Tool Works Inc., Glenview, Ill.

[21] Appl. No.: 597,071

[22] Filed: Feb. 5, 1996

[51] Int. Cl.[6] ..... B25C 1/04

[52] U.S. Cl. ..... 227/109; 227/120; 227/128; 227/136

[58] Field of Search ..... 227/109, 119, 227/120, 125, 130, 136, 128

[56] References Cited

U.S. PATENT DOCUMENTS

| | | | |
|---|---|---|---|
| 2,355,807 | 8/1944 | La Place | 227/123 |
| 2,409,049 | 10/1946 | Lang | 227/125 |
| 2,994,878 | 8/1961 | Abrahamsen | 227/134 |
| 3,007,171 | 11/1961 | Critchley | 227/109 |
| 3,026,518 | 3/1962 | Oussani | 227/128 |
| 3,238,983 | 3/1966 | Abrahamsen | 145/30 |
| 3,266,697 | 8/1966 | Fiedler | 227/120 |
| 3,437,249 | 4/1969 | Baum | 227/120 |
| 3,504,840 | 4/1970 | Wandel et al. | 227/130 |
| 3,604,608 | 9/1971 | Mullaney et al. | 227/120 |
| 3,615,049 | 10/1971 | Obergfell et al. | 227/120 X |
| 3,707,406 | 12/1972 | Perkins | 227/136 X |
| 3,980,179 | 9/1976 | Schrepferman | 227/120 X |
| 4,096,982 | 6/1978 | Stahl | 227/120 X |
| 4,463,888 | 8/1984 | Geist et al. | 227/109 |
| 4,558,811 | 12/1985 | Klaus | 227/116 |
| 4,597,517 | 7/1986 | Wagdy | 227/8 |
| 4,669,648 | 6/1987 | Monacelli | 227/109 |
| 4,784,306 | 11/1988 | Baum | 227/113 |
| 4,801,062 | 1/1989 | Austin | 227/125 |
| 4,815,647 | 3/1989 | Chou et al. | 227/109 |
| 4,863,089 | 9/1989 | McCardle et al. | 227/116 |
| 4,898,316 | 2/1990 | McLaughlin et al. | 227/120 |
| 5,038,993 | 8/1991 | Schafer et al. | 227/120 |
| 5,062,562 | 11/1991 | Michael | 227/111 |
| 5,273,200 | 12/1993 | Hoefier | 227/136 |
| 5,335,800 | 8/1994 | Liu | 227/120 X |
| 5,368,213 | 11/1994 | Massari | 227/123 |

*Primary Examiner*—Joseph J. Hail, III
*Assistant Examiner*—Jay A. Stelacone
*Attorney, Agent, or Firm*—Schwartz & Weinrieb

[57] ABSTRACT

A magazine for a nail-driving tool, which may be pneumatically powered or combustion-powered, is arranged to store a plurality of plural nail strips in side-by-side relationship. A spring-biased mechanism is used to bias the stored strips toward a side rail. Being movable along a frame between an advanced position and a retracted position, a feeding member in the retracted position engages the shank of an endmost nail of the stored strip nearest to the side rail. A negator spring mechanism biasing the feeding member toward the advanced position includes a leaf spring arranged to be longitudinally pulled between the nail heads of the stored ship nearest to the side rail and the nail heads of the next strip when the feeding member is moved from the advanced position into the retracted position. The feeding member has a wedging portion arranged to push between some of the nail shanks of the stored strip nearest to the side rail of the magazine and some of the nail shanks of the next strip and to lead the leaf spring when moved from the advanced position into the retracted position and a rail-engaging portion arranged to push between the side rail and some of the nail shanks nearest to the side rail when moved similarly. In an operative position, in which it can be releasably latched, a biasing member bears against the nearest strip. A floor member can be adjustably positioned. When latched, the biasing member latches the floor.

20 Claims, 5 Drawing Sheets

10
20
22
24
26
28
30
40
50
60
62
64
70
72
76
78
80
82
84
86
88
100
102
104
106
108
110
134
136
140
142
170
200
202
204
W

NAIL STRIP MAGAZINE WITH SPRING LEAF TO BIAS FEEDING MEMBER AND TO SEPARATE NAIL STRIPS

TECHNICAL FIELD OF THE INVENTION

This invention pertains to a magazine for use with a nail-driving tool, which may be pneumatically powered or combustion-powered. The magazine is arranged to store plurality of nail strips in a side-by-side relationship with respect to one another. This invention is characterized by a spring mechanism including a leaf spring functioning not only to bias a feeding member but also to be longitudinally pulled between a stored strip nearest to a side raft of the magazine and the next strip stored in the magazine.

BACKGROUND OF THE INVENTION

As exemplified in Wagdy U.S. Pat. No. 4,597,517, it is known to employ a so-called negator spring mechanism including a leaf spring to bias a feeding element of such a magazine. The leaf spring is arranged to uncoil as the feeding element is retracted and to recoil as the feeding element is advanced. As disclosed therein, however, the magazine appears to accommodate only one nail strip at any one time.

So-called box magazines for use with nail-driving tools, which may be pneumatically powered or combustion-powered, are exemplified in various prior patents including Fiedler U.S. Pat. No. 3,266,697, Baum U.S. Pat. No. 3,437,249, Wandel et al. U.S. Pat. No. 3,504,840, Baum U.S. Pat. No. 4,784,306, and Shafer et at U.S. Pat. No. 5,038,993. A box magazine is arranged to store plurality of nail strips in a side-by-side releationship with respect to one another.

In the patents identified in the preceding paragraph, complex pneumatic or mechanical mechanisms are disclosed for feeding such nail strips individually and successively from such box magazines into such driving tools. There has been a need, to which this invention is addressed, for an improved magazine employing simpler mechanisms for feeding such nail strips.

SUMMARY OF THE INVENTION

Addressing the need mentioned above, this invention provides a magazine for use with a nail-driving tool, which may be pneumatically powered or combustion-powered and which is arranged to receive a nail strip comprising a plurality of collated nails and to drive the nails individually and successively from the nail strip. The magazine is arranged to store a plurality of such nail strips in the side-by-side relationship with respect to one another. Being elongate, the magazine has an outlet end, an opposite end, and a side raft along one side of the magazine. The outlet end has a nail outlet, through which the stored strip nearest to the side raft of the magazine is feedable. According to this invention, the magazine employs a spring mechanism including a leaf spring in a novel manner.

Broadly, the magazine comprises a frame, means for biasing the stored strips toward the side raft of the magazine, and a feeding member movable along the frame between an advanced position near the outer end and a retracted position near the opposite end. The feeding member is adapted to feed the nail defining the trailing end of the stored strip nearest to the side rail of the magazine when the feeding member is released after having been moved to the retracted position. The feeding member is adapted to feed the strip having the engaged nail toward the outlet when the feeding member is moved from the retracted position toward the advanced position.

Further, the magazine comprises means including a spring mechanism having a leaf spring for biasing the feeding member toward the advanced position. The leaf spring has a leading end secured to the frame, near the outlet end of the magazine, and a trailing end secured to the feeding member and movable with the feeding member. The leaf spring is arranged to uncoil as the feeding member moves toward the retracted position and to recoil as the feeding member moves toward the advanced position. The leaf spring may be advantageously arranged to uncoil and recoil about an axis that is substantially parallel to the shanks of the nails of the stored strips. The spring mechanism may be a negator spring mechanism, which is preferred, or a clock spring mechanism.

As a characteristic feature of this invention, the leaf spring is arranged to be longitudinally pulled between the stored strip nearest to the side raft of the magazine and the next strip stored in the magazine when the feeding member is moved from the advanced position into the retracted position. Preferably, the leaf spring is arranged to be longitudinally pulled between the heads of the nails of the stored strip nearest to the side raft of the magazine and the heads of the nails of the next strip stored in the magazine when the feeding member is moved from the advanced position into the retracted position.

Preferably, the feeding member has a wedging portion arranged to push between the shanks of some of the nails of the stored strip nearest to the side raft of the magazine and the shanks of some of the nails of the next strip stored in the magazine and to lead the leaf spring between the separated strips when the feeding member is moved from the advanced position into the retracted position. Preferably, the feeding member has a raft-engaging portion arranged to push between the side raft of the magazine when the feeding member is moved from the advanced position into the retracted position. Preferably, the feeding member has a nail-confining portion adapted to confine, between the nail-confining portion and the side raft, the shanks of some of the nails of the nail strip nearest to the side raft.

In one contemplated embodiment, in which the magazine has an open side opposite to the side raft, the means for biasing the stored strips toward the side rail of the magazine includes a biasing member movable between an operative position, in which the biasing member extends through the open side and is is biased against the stored strip nearest to the open side, and an inoperative position, in which the biasing member is removed so as to permit such nail strips to be then be loaded into the magazine through the open side, means for latching the biasing member releasably in the operative position, and means for biasing the biasing member against the stored strip nearest to the open side when the biasing member is latched in the operative position. Preferably, in the foregoing embodiment, the biasing member is pivotably mounted upon the frame so as to be pivotably movable between the operative and inoperative positions.

In the foregoing embodiment, the magazine further comprises a floor member, which is arranged to underlie the stored strips and which is mounted to the frame so as to be adjustably positionable in any one of a plurality of positions to accommodate nail shanks of different lengths, and wherein the biasing member is arranged to latch the floor member in any of those positions when latched by the latching means and to release the floor member when released by the latching means. Preferably, in the foregoing embodiment, the biasing member is pivotably mounted upon to the frame so as to be pivotably movable between the operative and inoperative positions.

BRIEF DESCRIPTION OF THE DRAWINGS

These and other objects, features, and advantages of this invention will be evident from the following description of a preferred embodiment of this invention with reference to the accompanying drawings, in which like reference characters designate like or corresponding parts throughout the several views and wherein.

DETAILED DESCRIPTION OF THE PREFERRED EMBODIMENT

Figure 1:
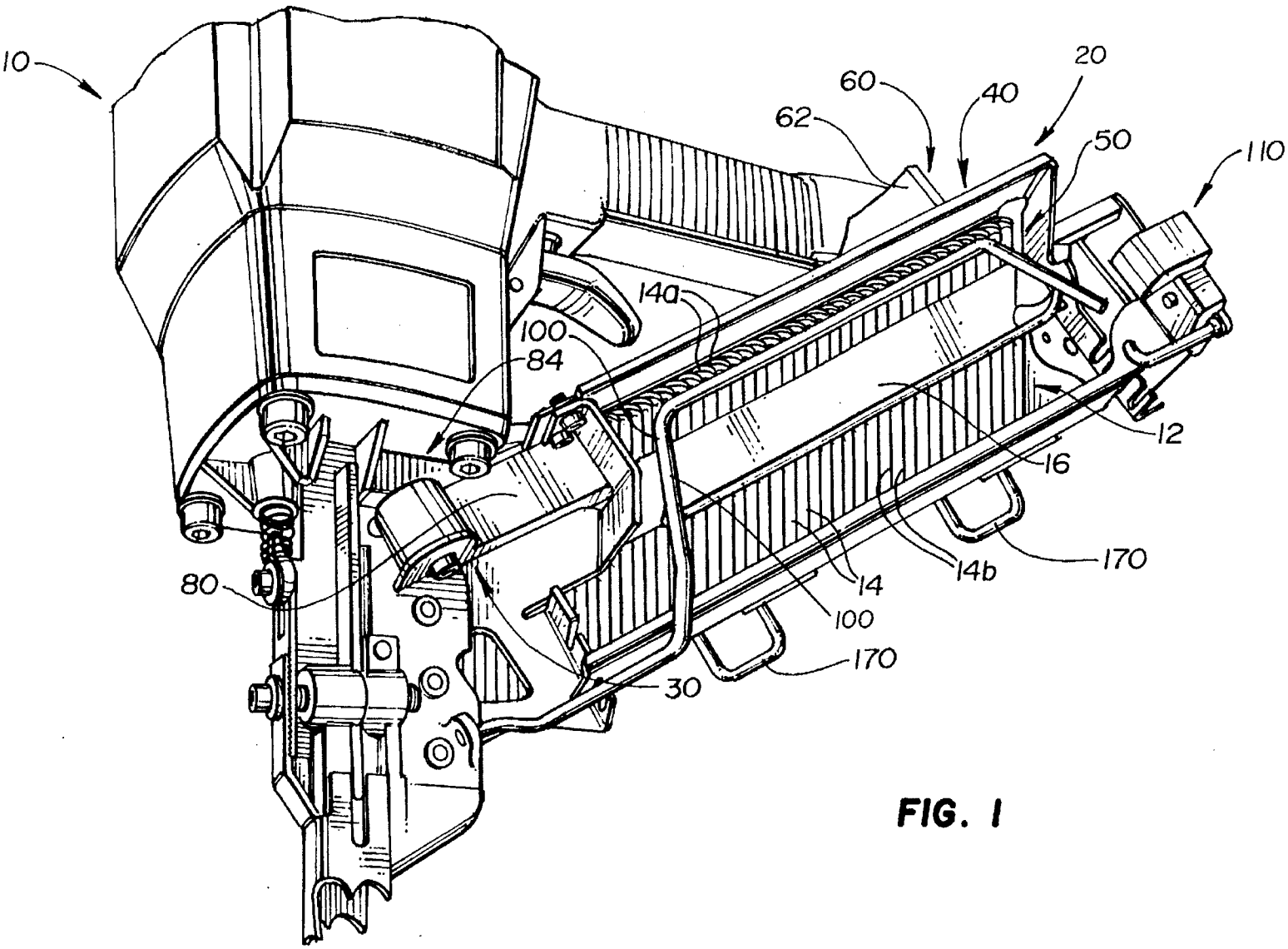
FIG. 1 is a fragmentary, perspective view of a pneumatically powered, nail-driving tool equipped with a magazine storing several nail strips and constituting a preferred embodiment of this invention.

As shown in the drawings, a pneumatically powered, nail-driving tool 10 arranged to receive a nail strip 12 of a known type comprising a plurality of collated nails 14 and to drive the nails 14 individually and successively from the nail strip 12 is equipped with a magazine 20 constituting a preferred embodiment of this invention. Each nail 14 has a head 14*a* and a shank 14*b*. The nails 14 of each nail strip 12 are joined to one another by means of paper tapes 16 on opposite sides of their shanks 14*b*. According to this invention, the magazine 20 employs a negator spring mechanism 30 to be later described, in a novel manner.

The nail strips 12 are similar to nail strips available commercially from ITW Paslode (a unit of Illinois Tool Works Inc.) of Vernon Hills, Ill., under its PASLODE trademark. The magazine 20 is arranged to store a plurality of such nail strips 12 in a side-by-side relationship with respect to one another. Being elongate, the magazine 20 has an outlet end 22, and opposite end 2A, and a side raft 26 along one side of the magazine 20. The outlet end 22 has a nail outlet (not shown) through which the stored strip 12 nearest to the side raft 26 is feedable. The magazine has an open side 28 opposite to the side raft 26. Except as shown and described herein, the nail-driving tool 10 may be substantially similar to the pneumatically powered, nail-driving tool disclosed in Golsch U.S. Pat. No. 4,932,480, the disclosure of which is incorporated herein by reference, and to pneumatically powered, nail-driving tools available commercially from ITW Paslode, supra, under its PASLODE trademark. The magazine 20 may be alternatively employed with a combustion-powered, nail-driving tool, as exemplified by combustion-powered, nail-driving tools available commercially from ITW Paslode, supra, under its IMPULSE trademark.

Broadly, the magazine 20 comprises a frame 40 including the side rail 26, means 50 to be later described for biasing the stored strips 12 toward the side rail 26, and a feeding member 60 movable along the side rail 26 of the frame 40, between an advanced position near the outlet end 22 and a retracted position near the opposite end 24. The side rail 26 is fixed to the frame 40, beneath the side rail 26. The feeding member 60 has a finger-engaging tab 62 enabling the feeding member 60 to be manually moved from the advanced position into the retracted position.

Figures 2, 3, 4:
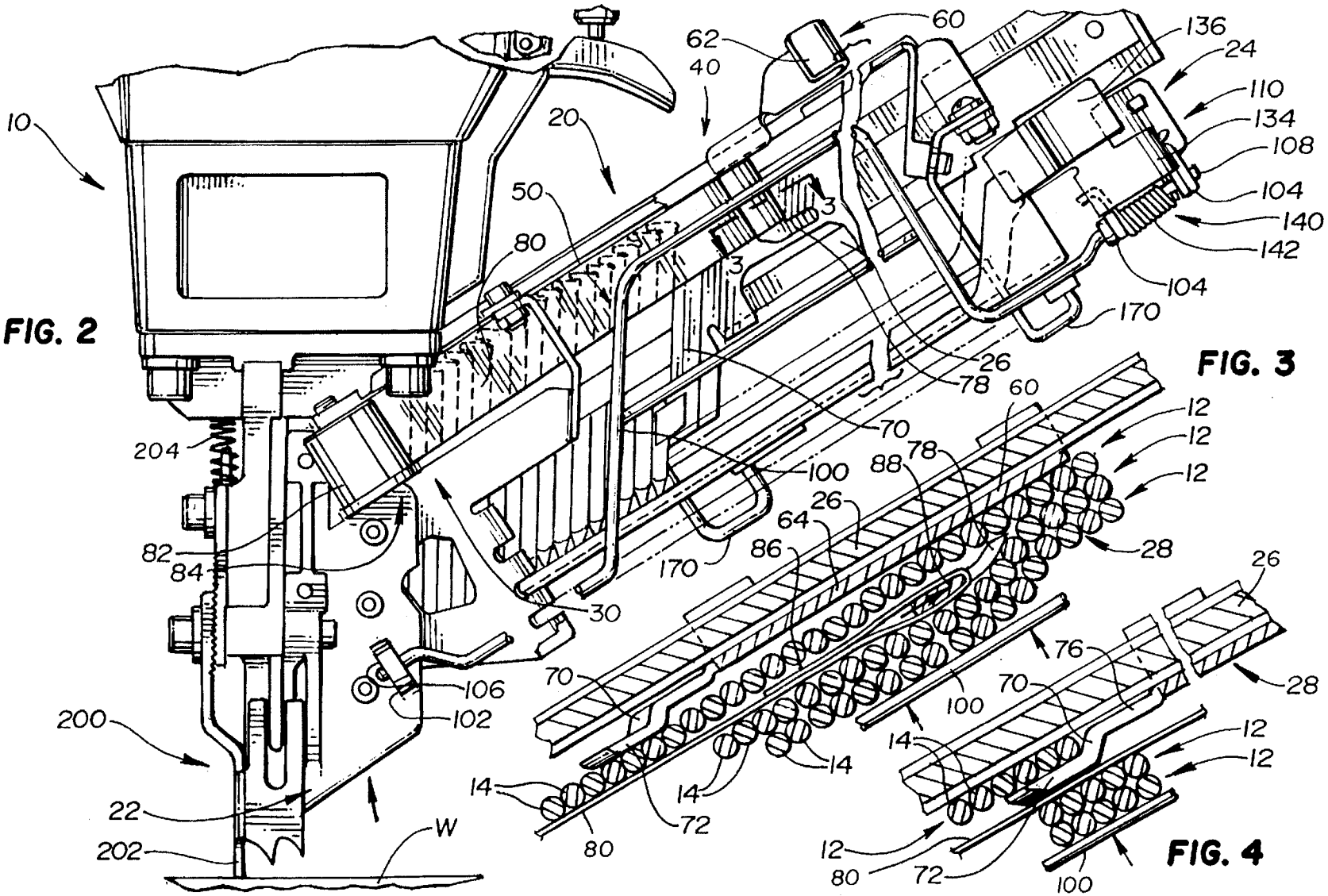
FIG. 2 is a fragmentary, elevational view of the nail-driving tool and of an open side of the magazine, as shown in FIG. 1, except that a feeding element has advanced from a retracted position into an intermediate position.
FIG. 3 is a fragmentary, sectional view taken along line 3—3 of FIG. 2, in the direction indicated by the arrows, and showing a feeding element as the feeding element is retracted so as to lead a leaf spring between the stored strip nearest to a side rail of the magazine and the next strip stored in the magazine.
FIG. 4 is a fragmentary, sectional view taken along a similar line, in a similar direction but showing the feeding element as the feeding element is advanced so as to feed the stored strip nearest to the side rail.

The feeding member 60 has a rail-engaging portion 64, which has two tabs 66 wrapped over an upper edge of the side rail 26 and two tabs 68 wrapped under a lower edge of the side rail 26. The feeding member 60 has a nail-engaging portion 70, which is adapted to engage the shank 14*b* of the nail 14 defining the trailing end of the stored strip 12 nearest to the side rail 26, as shown in FIG. 4, when the feeding member 60 is released after having been moved manually to the retracted position. The feeding member 60 has a nail-confining portion 72, which is adapted to confine, between the nail-confining portion 72 and the side rail 26, the shanks 14*b* of some of the nails 14 of the nail strip 12 nearest to the side rail 26.

Thus, the feeding member 60 is adapted to feed the strip 12 having the engaged nail 14 toward the nail outlet 26, as indicated by an arrow in FIG. 5, when the feeding member 60 is moved (by the negator spring mechanism 30 in a manner to be later described) from the retracted position toward the advanced position. Thus, after each nail 14 of a given strip 12 has been driven by the nail-driving tool 10, the same strip 12 is fed through the nail outlet 22 until the next nail 14 of the same strip 12 is positioned to be driven next.

The feeding member 60 has a rail-engaging portion 76, which extends backwardly from the nail-engaging portion 70, and which is arranged to push between the side raft 26 and the shanks 14*b* of some of the nails 14 of the stored strip 12 nearest to the side rail 26 when the feeding member 60 is moved from the advanced position into the retracted position. The feeding member 60 has a wedging portion 78, which is arranged to push between the shanks 14*b* of some of the nails 14 of the stored strip 12 nearest to the side rail 26 and the shanks 14*b* of some of the nails 14 of the next strip 12 stored in the magazine 20 when the feeding member 60 is moved from the advanced position into the retracted position.

The negator spring mechanism 30 has a leaf spring 80, which is arranged to uncoil as the feeding member 60 moves toward the retracted position, and to recoil (coil again) as the feeding member 60 moves toward the advanced position. Advantageously, as shown, the leaf spring is arranged to uncoil and recoil about an axis that is substantially parallel to the shanks 14*b* of the nails 14 of the stored strips 12.

The leaf spring 80 has a leading end 82, which is coiled and which is secured to the frame 40, near the outlet 22 of the magazine 20, by means of a spool 84. The leaf spring 80 has a trailing end 86, which is secured to a columnar portion 88 of the feeding member 60, the wedging portion 78 extending from the columnar portion 88. The trailing end 86 is wrapped around the columnar portion 88, near the wedging portion 78 of the feeding member 60, and is spot-welded to itself. The wedging portion 78 of the feeding member 60 is arranged to lead the leaf spring 80 between the separated strips 12 when the feeding member 60 is moved from the advanced position into the retracted position. Thus, as a characteristic feature of this invention, the leaf spring 80 is arranged to be pulled between the shanks 14*b* of the nails 14 of the stored strip 12 nearest to the side raft 26 and the shanks 14*b* of the nails 14 of the next strip 12 stored in the magazine 20, as shown in FIG. 3, when the feeding member 60 is moved from the advanced position into the retracted position. The leaf spring leaf 80 and the nail-confining portion 72, which moves along the leaf spring 80, separate the nail strip 12 being fed from the other strips 14 stored in the magazine 20, as shown in FIG. 5, when the feeding member 60 is advanced. The means 50 for biasing the stored strips 12 toward the side rail 26 are described next. The biasing means 50 include a biasing member 100, which is made from welded wires and which is mounted to the frame 40, by means of a pivot mount 102 near the outlet end 22 of the magazine 20 and two pivot mounts 104 near the opposite end 24 of the magazine, so as to be pivotably movable between an operative position and an inoperative position. The pivot mounts 102, 104, are aligned with each other so as to define a pivot axis for the biasing member 100 and receive respective wire ends 106, 108, of the biasing member 100.

Figure 5:
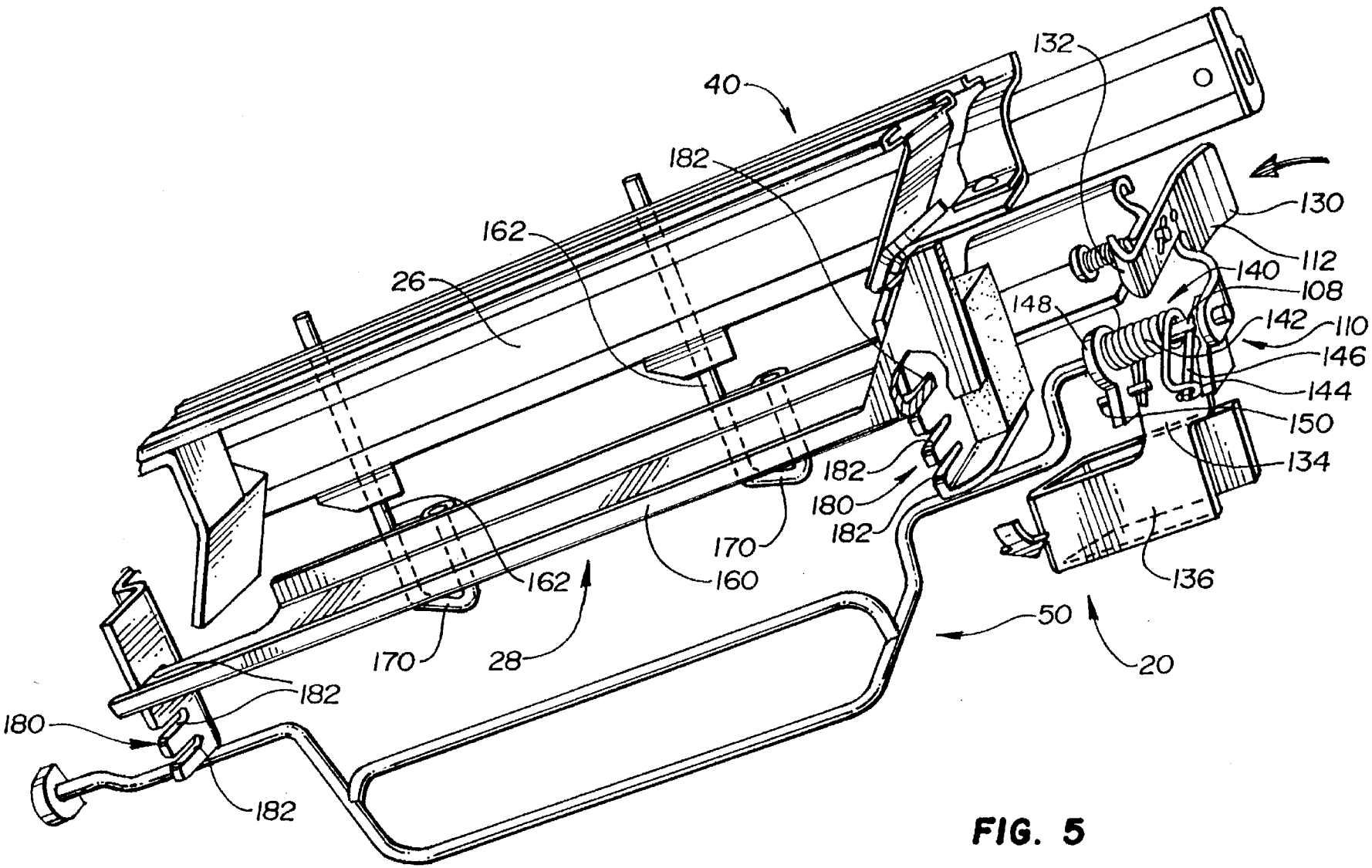
FIG. 5 is a fragmentary, perspective view of the other side of the magazine, in an opened condition, without the nail strips.

In the operative position, in which the biasing member 100 is shown in FIGS. 1, 2, 3, and 4, the biasing member 100 extends into the magazine 20, through the open side 28, which is opposite to the side raft 26 In the inoperative position, in which the biasing member 100 is shown in FIG. 5, the biasing member 100 is opened with respect to the magazine 20 so as to permit such nail strips 12 to then be loaded into the magazine 20 through the open side 28. Further, the biasing means 50 includes means 110 for releasably latching the biasing member 100 releasably in the operative position.

Figure 6:
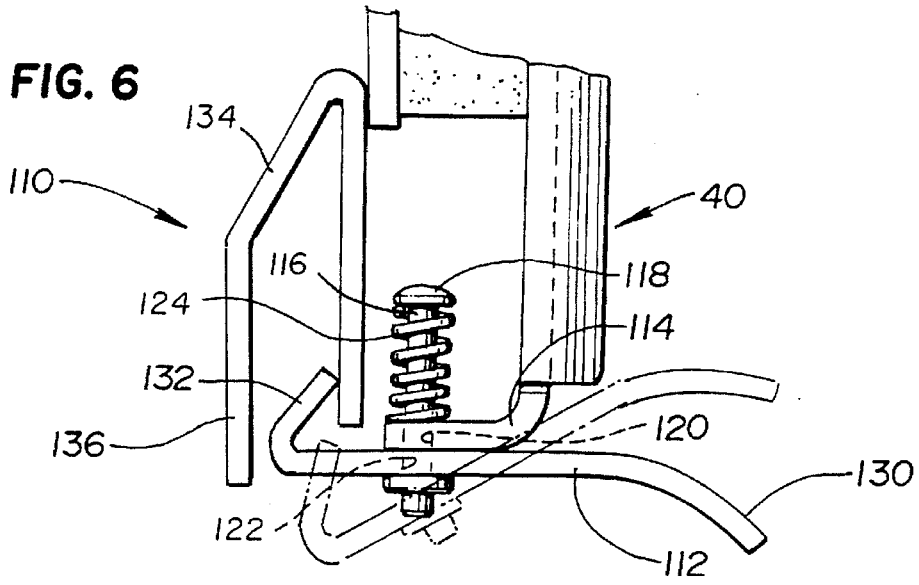
FIG. 6, on a layer scale, is a fragmentary detail of a latching mechanism of the magazine, as seen from above.
Figure 7:
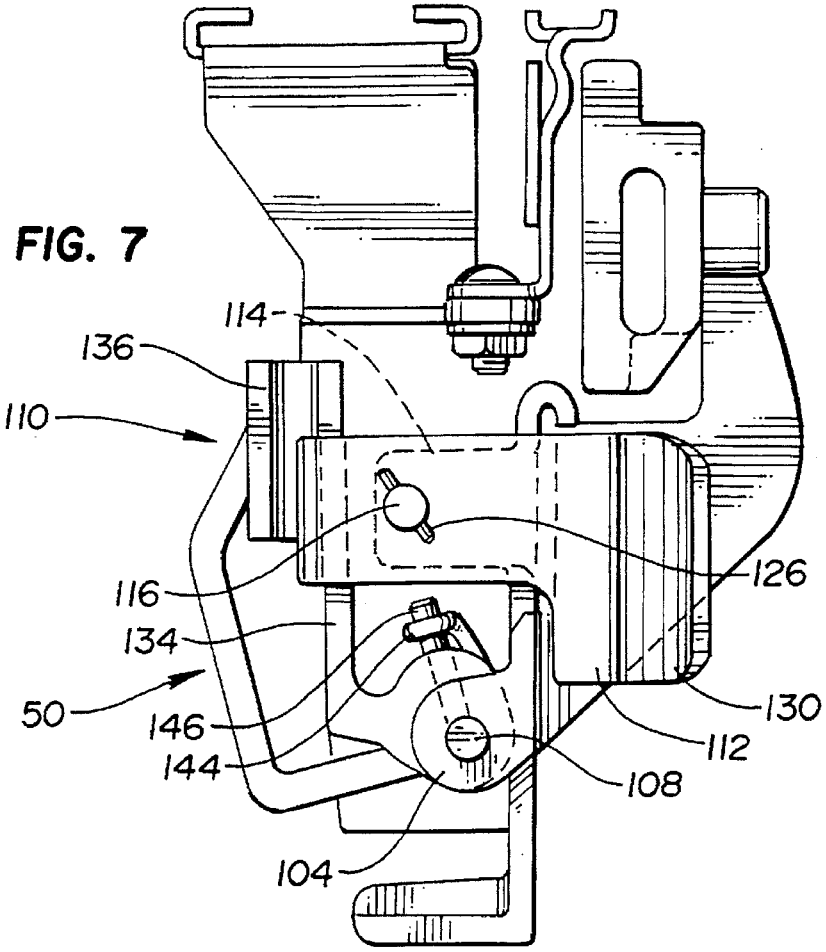
FIG. 7, on a similar scale, is a fragmentary detail of the latching mechanism shown in FIG. 5, as seen from one end of the magazine.

As shown in FIGS. 5, 6,and 7 and other views, the latching means 110 comprises a lever 112, which is mounted to the frame 40 so as to be pivotably movable about a curved tongue 114 of the frame 40 between a latching position and a range of unlatching positions. In FIG. 6, the lever 112 is shown in the latching position, in full lines, and in an unlatching position, in dashed lines. Moreover, the latching means 110 comprises a post 116 having a head 118 and passing through an aperture 120 in the curved tongue 114, and through an aperture 122 in the tongue 114, a coiled spring 124 deployed around the post 116 and compressed between the head 118 and the lever 112, and a cotter pin 126 passing through a hole (not shown) in the post 116, beyond the aperture 12 in the lever 112, so as to secure the lever 112, the post 116, and the spring 124 operatively to the frame 40, near the tongue 114. The lever 112 has a curved end 130, by which the lever 112 can be manually actuated to pivot the lever 112 from the latching position into the unlatching position, and a hooked end 132.

Moreover, the latching means 110 comprises a latch 134, which is mounted to the frame 40 so as to be pivotably movable about the pivot 104, between a latched position and a range of unlatched positions. In FIG. 5, the latch 134 is shown in an unlatched position. In FIGS. 6 and 7, the latch 134 is shown in the latched position. The latch 134 has a distal end 136, which is vee-shaped to receive the hooked end 132 of the lever 112, as shown in FIG. 6 and other views, when the lever 112 resides in the latching position and the latch 134 resides in the latched position.

Moreover, the biasing means 50 includes means 140 for biasing the biasing member 100 into the magazine 20, against the stored strip 12 nearest to the open side 28, when the biasing member 100 is latched in the operative position. The means 140 comprises a torsion spring 142, which has a leg 144 connected to the wire end 108 of the biasing member 1130 by means of a pin 146 near the pivot 104, so as to turn conjointly with the biasing member 100, about the pivot 104, when the biasing member 100 is pivoted, and which has a leg 148 connected to the latch 134 by means of a pin 150 so as to turn conjointly with the latch 134 about the pivot 104, when the latch 134 is pivoted. The torsion spring 142 is arranged to latch the biasing member 100 in the operative position and to bias the biasing member 100 into the interior of the magazine 20, against the stored strip 12 nearest to the open side 28, when the distal end 136 of the latch 134 receives the hooked end 132 of the lever 112. The torsion spring 142 is arranged to unlatch the biasing member 100 and to permit the biasing member 100 to be freely removed from the interior of the magazine 20 when the lever-112 is actuated so as to release the latch 134. Also, when the lever 112 is actuated so as to release the latch 134, the latch 134 tends to spring from the latched position into an unlatched position because of energy stored in the torsion spring 142.

As shown in FIG. 5 and other views, the magazine 20 comprises a floor member 160, which is arranged to underlie the stored strips 12. The floor member 160 is mounted to the frame 40 so as to be adjustably positionable in any of several positions-to accommodate nail shanks of different lengths. The floor member 160 is mounted to the frame 40, by means of two similar posts 162 extending through two similar guides 164 affixed to the frame 40, so as to be adjustably positionable over a limited range of post adjustment. The limited range of post adjustment is defined by the guides coacting with enlarged caps formed or provided on the posts 162 and with annular rings 168 formed or provided on the posts 162. The posts 162 are rotatable in the guides 164, over a limited range of post rotation, and are extended downwardly and beneath the magazine 20 so as to define two similar brackets 170 mounting the floor member 160 as two similar swivels 172 permitting relative swivelling movement between the floor member 160 and the posts 162 as the posts 62 are rotated in the guides 164.

Moreover, the frame 40 is provided with two slotted brackets 180, each having slots 182 at different positions. Each slot 182 is arranged to receive the floor member 160 when the posts 162 and the floor member 160 are adjusted to a suitable position within the limited range of post adjustment and when the posts 162 are rotated toward one extreme position within the limited range of post rotation so as to cause relative swivelling movement between the floor member 160 and the posts 162. The posts 162 are rotatable to intermediate positions within the limited range of post rotation, so as to remove the floor member 160 from the slotted brackets 180, whereupon the posts 162 and the floor member 160 can then be adjusted to a different position within the limited range of post adjustment.

Thus, the biasing member 100 is arranged to bear against the floor member 160, so as to latch the floor member 160 in the slots 182 at any of the several positions defined by the slotted brackets 180, when the biasing member 100 is latched by the latching means 110. Thus, the biasing member 100 is arranged to release the floor member 160, so as to permit the posts 162 and the floor member 160 to then be adjusted to a different position within the limited range of post adjustment, when the biasing member 100 is released by the latching means 110.

As shown in FIG. 2 and other views, the nail-driving tool 10 is provided with a tool-actuating mechanism 200 of a known type. The tool-actuating mechanism 200 is arranged in a known manner to disable the nail-driving tool 10 unless a workpiece-contacting element 202, which is biased away from the nail-driving tool 10, to a deactuating position, by springs 204, is pressed firmly against a workpiece W so as to move the workpiece-contacting element 202 toward the nail-driving tool 10, to an actuating position. Details of the tool actuating mechanism 200 are outside the scope of this invention.

Figures 8, 9:
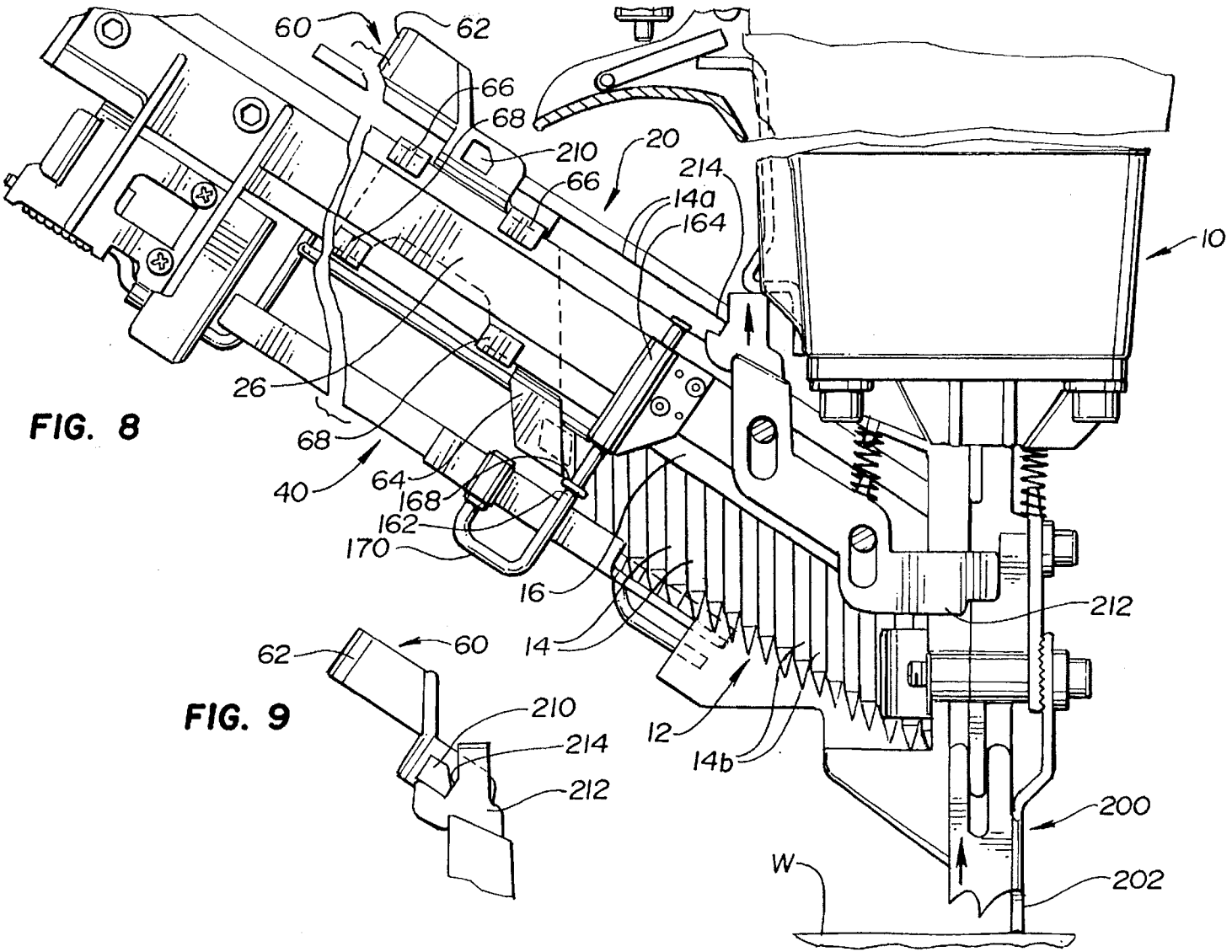
FIG. 8 is a fragmentary, elevational view of the nail-driving tool and of the other side of the magazine, as shown in FIG. 2.
FIG. 9 is a fragmentary detail of the feeding element interlocking with another element, as shown in FIG. 8, except that the feeding mechanism has advanced to an advanced position, to which the feeding element advances when all nails of the stored strip nearest to the side raft of the magazine have been driven by the nail-driving tool.

As shown in FIGS. 8 and 9, the feeding member 60 has a hub 210, which is arranged to arrest the workpiece-contacting element 202, so as to prevent the workpiece-contacting element 202 from moving to the actuating position when the feeding member 60 has been moved into the advanced position because all nails 12 of a given strip 14 have been driven. An arm 212 is mounted to the workpiece-contacting element 202 so as to be conjoin fly movable with the workpiece-contacting element 202. The arm 212 has a recess 214, which is arranged to receive the hub 210 when the feeding member 60 has been moved into the advanced position. Thus, the nail-driving tool 10 cannot be again operated again until the feeding member 60 has been moved from the advanced position toward the retracted position.

Herein, directional terms such as "upper", "lower", "upwardly", and "downwardly" are used to refer to the nail-driving tool 10 and the magazine 20 in a common orientation, as shown, not to limit this invention to any particular orientation.

Various modifications may be made in the preferred embodiment described above without departing from the scope and spirit of this invention.

We claim:

1. A magazine, for use with a nail-driving tool adapted to receive at least one nail strip comprising a plurality of collated nails and to drive said nails individually and successively from said nail strip, for storing a plurality of said nail strips in a side-by-side relationship with respect to one another so that each stored nail strip has a nail defining a leading end of said nail strip and a nail defining a trailing end of said nail strip, said magazine being elongate, having an outlet end, an opposite end, and a side rail along one side of said magazine, said outlet end of said magazine having an outlet through which the stored strip disposed nearest to said side rail of said magazine is feedable, and wherein each nail of each nail strip stored within said magazine has a head an shank, said magazine comprising:

a frame;

means for biasing said stored strips of nails toward said side rail of said magazine;

a feeding member movable along said frame between an advanced position near said outlet end of said magazine and a retracted position near said opposite end of said magazine, said feeding member having a nail-engaging portion for engaging said nail defining said trailing end of said stored nail strip disposed nearest to said side rail of said magazine when said feeding member is released from said retracted position, after having been moved to said retracted position, so as to feed said nail strip, having said engaged nail, toward said outlet of said magazine when said feeding member is moved from said retracted position toward said advanced position; and means comprising a leaf spring for biasing said feeding member toward said advanced position, said leaf spring having a leading end secured to said frame at a position near said outlet end of said magazine, a trailing end secured to said feeding member and movable along with said feeding member, said leaf spring being disposed so as to uncoil as said feeding member is moved toward said retracted position, to recoil as said feeding member is moved toward said advanced position, and to be longitudinally interposed between said stored nail strip disposed nearest to said side rail of said magazine and the next nail strip stored within said magazine when said feeding member is moved from said advanced position to said retracted position as well as when said feeding member is moved from said retracted position to said advanced position.

2. The magazine of claim 1 wherein the leaf spring is arranged to be longitudinally pulled between the heads of the nails of the stored strip disposed nearest to the side rail of the magazine and the heads of the nails of the next strip stored in the magazine when the feeding member is moved from the advanced position to the retracted position.

3. The magazine of claim 2, wherein:

said feeding member has a wedging portion for insertion between said shanks of some of said nails of the stored nail strip disposed nearest to said side rail of said magazine and said shanks of some of said nails of the next nail strip stored within said magazine so as to lead said leaf spring when said feeding member is moved from said advanced position to said retracted position.

4. The magazine of claim 2 wherein the feeding member has a rail-engaging portion interposed between the side rail of the magazine and the shanks of some of the nails of the stored nail strip disposed nearest to the side rail of the magazine when the feeding member is moved from the advanced position into the retracted position.

5. The magazine of claim 2 wherein the feeding member has a nail-confining portion adapted to confine, between the nail-confining portion and the side rail, the shanks of some of the nails of the nail strip disposed nearest to the side rail between.

6. The magazine of claim 5, wherein:

said feeding member has a wedging portion for insertion between said shanks of some of said nails of the stored nail strip disposed nearest to said side rail of said magazine and said shanks of some of said nails of the next nail strip stored within said magazine so as to lead said leaf spring between said strip disposed nearest to said side rail of said magazine and said next strip stored within said magazine when said feeding member is moved from said advanced position to said retracted position, and wherein further, said feeding member has a rail-engaging portion interposed between said side rail of said magazine and said shanks of said nails of the stored nail strip disposed nearest to said side rail of said magazine when said feeding member is moved from said advanced position to said retracted position.

7. The magazine of claim 1 wherein the leaf spring is arranged to uncoil and recoil about an axis that is substantially parallel to the shanks of the nails of the stored strips.

8. The magazine of claim 1, wherein:

said magazine has an open side disposed opposite to said side rail; and said means for biasing said stored nail strips toward said side rail of said magazine comprises a biasing member movable between an operative position, at which said biasing member extends through said open side of said magazine and is biased against the stored nail strip disposed nearest to said open side of said magazine, and an inoperative position, at which said biasing member is disposed away from said open side of said magazine so as to permit said plurality of nail strips to be loaded into said magazine through said open side of said magazine, said means for biasing said stored nail strips toward said side rail of said magazine further comprises means for releasably latching said biasing member at said operative position, and means for biasing said biasing member against the stored nail strip disposed nearest to said open side of said magazine when said biasing member is latched at said operative position.

9. The magazine of claim 8 wherein the biasing member is pivotably mounted to the frame so as to be pivotably movable between the operative and inoperative positions.

10. The magazine of claim 8, wherein said magazine further comprises:

a floor member which is disposed beneath said stored nail strips; and means for adjustably mounting said floor member upon said frame so as to be adjustably positionable in any one of a plurality of positions so as to accommodate nail shanks of different lengths.

11. The magazine of claim 13 wherein the biasing member is pivotably mounted to the frame so as to be pivotably movable between the operative and inoperative positions.

12. The magazine as set forth in claim 8, wherein:

said means for biasing said biasing member comprises a torsion spring.

13. The magazine as set forth in claim 10, wherein:

said biasing member is disposed in contact with said floor member when said biasing member is disposed at said operative position so as to retain said floor member at a particular one of said plurality of positions.

14. The magazine as set forth in claim 10, wherein:

said means for adjustably mounting said floor member comprises a pair of slotted mounting brackets having a plurality of slots defined therein within which said floor member may be selectively disposed so as to selectively determine the disposition of said floor member with respect to said magazine.

15. A magazine, for use with a nail-driving tool adapted to receive at least one nail strip comprising a plurality of collated nails and to drive said nails individually and successively from said nail strip, for storing a plurality of said nail strips in a side-by-side relationship with respect to one another so that each stored nail strip has a nail defining a leading end of said nail strip and a nail defining a trailing end of said nail strip, said magazine being elongate, having an outlet end, an opposite end, and a side rail along one side of said magazine, said outlet end of said magazine having an outlet through which the stored nail strip disposed nearest to said side rail of said magazine is feedable, and wherein each nail of each nail strip stored within said magazine has a head and a shank, said magazine comprising:

a frame;

means for biasing said stored strips of nails toward said side rail of said magazine;

a feeding member movable along said frame between an advanced position near said outlet end of said magazine and a retracted position near said opposite end of said magazine, said feeding member having a nail-engaging portion for engaging said nail defining said trailing end of said stored nail strip disposed nearest to said side rail of said magazine when said feeding member is released from said retracted position, after having been moved to said retracted position, so as to feed said nail strip, having said engaged nail, toward said outlet of said magazine when said feeding member is moved from said retracted position toward said advanced position; and spring means for biasing said feeding member toward said advanced position, said spring means having a leading end secured to said frame at a position near said outlet end of said magazine, a trailing end secured to said feeding member and movable along with said feeding member, said spring means being disposed so as to uncoil as said feeding member is moved toward said retracted position, to recoil as said feeding member is moved toward said advanced position, and to be longitudinally interposed between said stored nail strip disposed nearest to said side rail of said magazine and the next nail strip stored within said magazine when said feeding member is moved from said advanced position to said retracted position as well as when said feeding member is moved from said retracted position toward said advanced position.

16. The magazine as set forth in claim 15, wherein:

said feeding member has a wedging portion for insertion between said shanks of some of said nails of the stored nail strip disposed nearest to said side rail of said magazine and said shanks of some of said nails of the next nail strip stored within said magazine so as to lead said spring means when said feeding member is is moved from said advanced position to said retracted position.

17. The magazine as set forth in claim 16, wherein:

said feeding member has a rail-engaging portion interposed between said side rail of said magazine and said shanks of some of said nails of said nail strip disposed nearest to said side rail of said magazine when said feeding member is moved from said advanced position to said retracted position.

18. The magazine as set forth in claim 17, wherein:

said rail-engaging portion of said feeding member and said spring means are disposed within substantially parallel planes disposed substantially parallel to said side rail of said magazine.

19. The magazine as set forth in claim 15, wherein:

said magazine has an open side disposed opposite to said side rail; and said means for biasing said stored nail strips toward said side rail of said magazine comprises a biasing member movable between an operative position, at which said biasing member extend through said open side of said magazine and is biased against the stored nail strip disposed nearest to said open side of said magazine, and an inoperative position, at which said biasing member is disposed away from said open side of said magazine so as to permit said plurality of nail strips to be loaded into said magazine through said open side of said magazine, said means for biasing said stored nail strips toward said side rail of said magazine further comprising means for releasably latching said biasing member at said operative position, and means for biasing said biasing member against the stored nail strip disposed nearest to said open side of said magazine when said biasing member is latched at said operative position.

20. The magazine as set forth in claim 15, wherein said magazine further comprises:

a floor member which is disposed beneath said stored nail strips; and means for adjustably mounting said floor member upon said frame so as to be adjustably positionable to any one of a plurality of positions so as to accommodate nail shanks of different lengths.

* * * * *